US006698393B2

(12) United States Patent
Nomura

(10) Patent No.: US 6,698,393 B2
(45) Date of Patent: Mar. 2, 2004

(54) CRANKSHAFT PHASE ADJUSTMENT STRUCTURE

(75) Inventor: Akifumi Nomura, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/199,110

(22) Filed: Jul. 22, 2002

(65) Prior Publication Data

US 2003/0037755 A1 Feb. 27, 2003

(30) Foreign Application Priority Data

Aug. 22, 2001 (JP) ..... 2001-252168

(51) Int. Cl.[7] ..... F02F 7/00
(52) U.S. Cl. ..... 123/195 C
(58) Field of Search ..... 123/195 C, 195 R, 123/198 R

(56) References Cited

U.S. PATENT DOCUMENTS 4,676,065 A * 6/1987 Eberhardt ..... 60/310
5,458,100 A * 10/1995 Neuenfeld ..... 123/195 A
5,546,901 A * 8/1996 Acker et al. ..... 123/195 C

FOREIGN PATENT DOCUMENTS

JP 1-14745 4/1989

* cited by examiner

*Primary Examiner*—Tony M. Argenbright
*Assistant Examiner*—Katrina B. Harris
(74) *Attorney, Agent, or Firm*—Birch, Stewart, Kolasch & Birch, LLP

(57) ABSTRACT

A crankshaft phase adjustment structure for performing work via a single window. A clutch and ACG are arranged on both right and left sides of a crankcase. On the side of the clutch of the crankshaft, a primary drive gear engaged with a primary driven gear of the clutch is fixed by a bolt. A window for performing work is open to a case cover in the vicinity of the bolt and is covered with a cap. The center line of the window for performing work is set off the axis of the bolt, the window for performing work is located in a position in which a head of the bolt and an alignment mark provided to the outside periphery of the side of the primary drive gear are simultaneously viewed. At the edge of the window for performing work a second alignment mark is provided.

12 Claims, 5 Drawing Sheets

CRANKSHAFT PHASE ADJUSTMENT STRUCTURE

CROSS-REFERENCE TO RELATED APPLICATIONS

The present application claims priority under 35 USC 119 to Japanese Patent Application No. 2001-252168 filed on Aug. 22, 2001 the entire contents thereof is hereby incorporated by reference.

BACKGROUND OF THE INVENTION

1. Field of the Invention

The present invention relates to crankshaft phase adjustment structure and more particularly relates to the arrangement structure of a window for performing work for phase adjustment.

2. Description of Background Art

In Japanese published examined utility model application No. Hei 1-14745, an engine is disclosed in which an ACG for power generation is provided to one end of a crankshaft and a plurality of windows for performing work via which the end of the crankshaft and the outside periphery of the ACG can be viewed are provided to a case cover covering the side of the ACG.

In the case where a phase is adjusted in the structure, first a cap for the window for performing work is removed, the crankshaft is rotated from the outside by turning a bolt that tightens an ACG on the crankshaft via the window for performing work is located on an extended line of the crankshaft, a top dead center of a piston is adjusted, checking the position of an alignment mark provided to a flywheel of ACG from another window for performing work and a phase of the engine is adjusted.

As the structure becomes more complex when a plurality of windows for performing work are provided as described above, it is desired that a structure should be provided wherein a window for performing work can be simplified. As a window for performing work cannot be provided to a case cover on the side of the ACG when an engine is configured so that oil is supplied from the side of the ACG to an oil passage of a crankshaft, the arrangement structure of a window for performing work that is suitable for such a lubrication structure is also desired. The object of the invention is to realize such requests.

SUMMARY AND OBJECTS OF THE INVENTION

To solve the above problem, the present invention is directed to a crankshaft phase adjustment structure that is based upon an engine in which a primary drive gear is provided to the side of one end of a crankshaft and an ACG is provided to the side of the other end and which is configured so that oil is supplied to an oil passage provided to the axis of the crankshaft wherein the oil passage of the crankshaft is open to the end of the crankshaft on the side of the ACG. A window is provided for performing work for adjusting a phase that is formed in a position in the vicinity of an extended line of the axis of the crankshaft of a case cover on the side of the primary drive gear and an alignment mark is provided to the crankshaft that can be viewed from the window for performing work or a part rotated integrally with the crankshaft and the edge of the window for performing work.

The present invention includes a center of the window for performing work that is set off from the axis of the crankshaft.

According to the present invention, as the window for performing work in the vicinity of the extended line of the crankshaft is provided to the case cover on the side of the clutch and the window for performing work on the case cover on the side of ACG is done away with, a lubrication structure in which oil is supplied from the side of ACG to the crankshaft is enabled.

As the window for performing work is provided to the position in which the crankshaft or the part rotated integrally with the crankshaft can be viewed on the case cover on the side of the clutch and the alignment mark is provided to the edge of the window for performing work and the crankshaft or the part rotated integrally with the crankshaft, the rotation of the crankshaft can be adjusted, checking the alignment mark from the same window for performing work. Therefore, the adjustment of a phase of the crankshaft is facilitated, as the window for performing work can be simplified, the structure of the window for performing work can be simplified and in addition, the lightening and the reduction of the cost are enabled.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
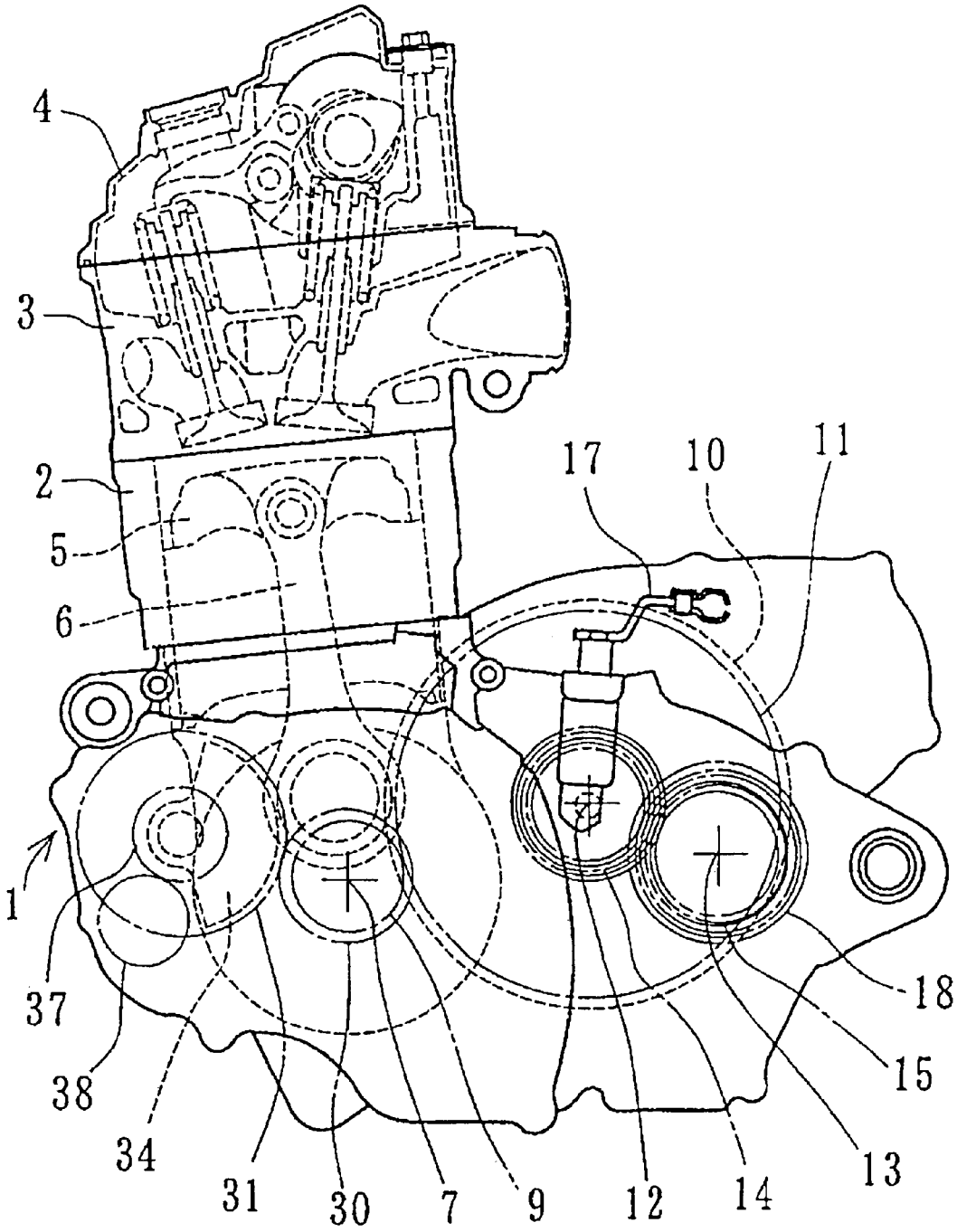
FIG. 1 is a left side view showing a water-cooled four-cycle engine to which this embodiment is applied.

As shown in FIG. 1, in this engine, a cylinder block 2 is provided over a crankcase 1. A cylinder head 3 and a cylinder head cover 4 are provided on/over the cylinder block. A piston 5 is slid in the cylinder block 2 so that it can be reciprocated for rotating the crankshaft 7 (the reference number indicates the center) via a connecting rod 6. The crankshaft 7 is housed in the crankcase 1 and is engaged with a primary driven gear 11 integrated with a clutch 10 via a primary drive gear 9 provided on the crankshaft 7.

The main shaft 12 and the countershaft 13 (the reference numbers indicate the respective center) respectively forming a transmission mechanism are arranged in parallel with the crankshaft 7 with plural transmission gears 14 and 15 provided on the respective shafts that are always engaged. The plural transmission gears 14 and 15 are housed in a transmission case in the crankcase 1. The main shaft 12 is connected to the clutch 10 for intermittently operating the clutch 10 by a clutch lever 17. The combination of the transmission gears 14 and 15 is selected by a well-known gear selecting mechanism and a shift is output to an output sprocket 18 provided to one end of the countershaft 13.

Figure 2:
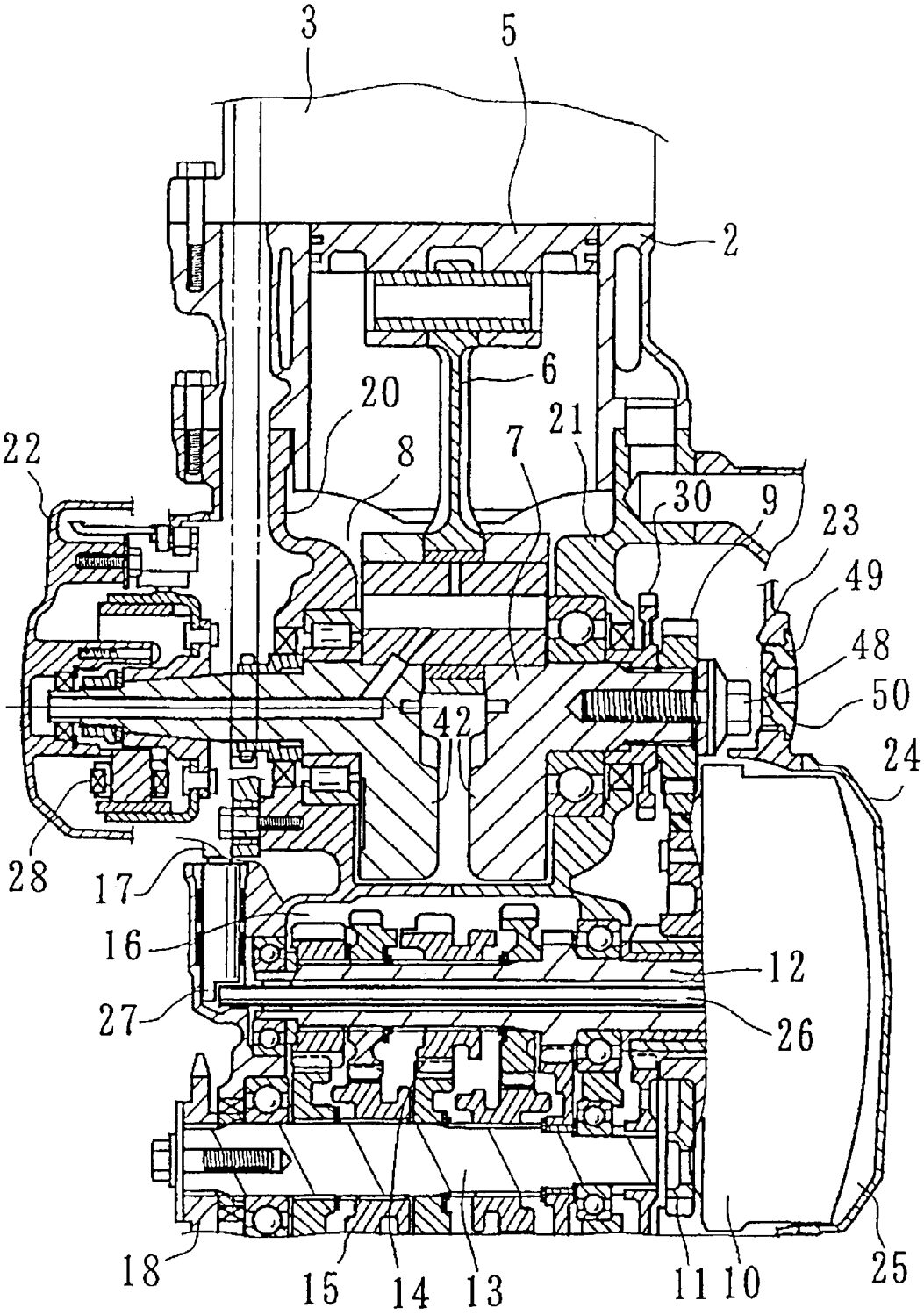
FIG. 2 is a sectional view showing a main part of the engine.

As shown in FIG. 2, the crankcase 1 is divided into right and left parts. The crankcase is composed of a case L 20 on the left side and a case R 21 on the right side, and a case L cover 22 and a case R cover 23 are attached to the respective outsides.

The crankshaft 7, the main shaft 12 and the countershaft 13 are respectively supported by a bearing between the case L 20 and the case R 21, and the crankshaft 7 is housed in the crankcase 8 formed in a sealed state between the case L 20 and the case R 21. The transmission mechanism including the main shaft 12, the countershaft 13 and the transmission gears 14 and 15 is housed in a transmission case 16 formed between the case L 20 and the case R 21 next to the crankcase 8. The crankcase 8 is partitioned by the transmission case 16 and a partition to be sealed. A clutch housing 25 is formed among the case R 21, the case R cover 23 and a clutch cover 24, and a wet clutch is housed here.

The main shaft 12 that is connected to the clutch 10 is a hollow shaft. A push rod 26 pierces the main shaft and the clutch is intermittently operated by pushing one end of the push rod by a cam 27 formed at one end of the clutch lever 17. ACG 28 is provided to one end of the crankshaft 7.

Figure 3:
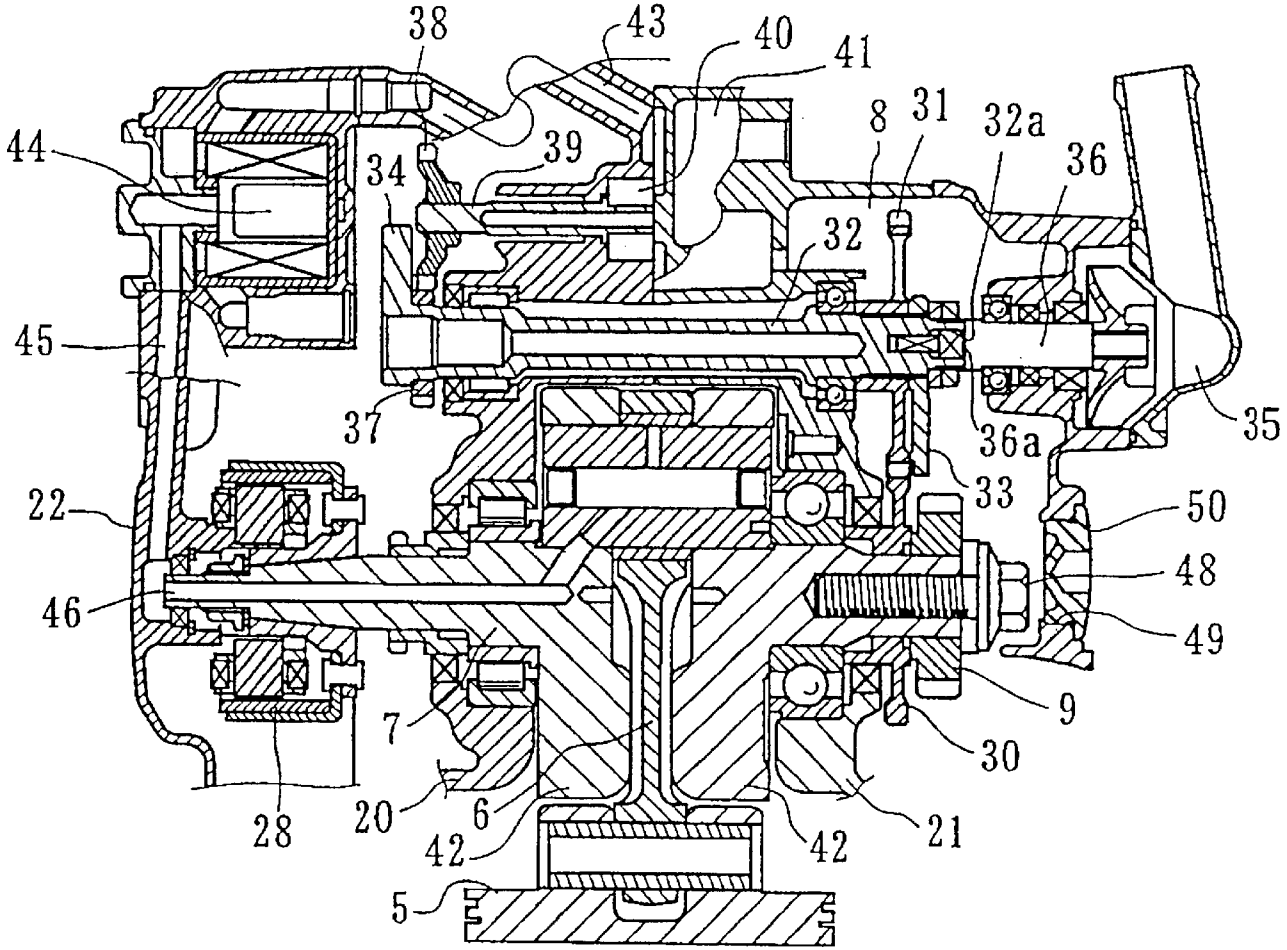
FIG. 3 is a sectional view showing a balancer mechanism.

As shown in FIG. 3, a balancer drive gear 30 is provided in the vicinity of the primary drive gear 9 on the crankshaft 7, and a balancer driven gear 31 engaged with the balancer drive gear is provided at one end of a balancer shaft 32. The balancer shaft 32 is arranged in parallel with the crankshaft 7, is supported between the case L 20 and the case R 21 and balancer weights 33 and 34 are provided at both ends. One balancer weight 33 is provided separately from the balancer driven gear 31 with one balancer weight axially overlapped with the balancer driven gear, and the other balancer weight 34 is integrated with the other end of the balancer shaft 32.

An axial fitting hole 32*a* is provided to the end to which the balancer weight 33 is provided of the balancer shaft 32, the end with an anomalous outline 36*a* formed on a driving shaft 36 of a water pump 35 is fitted into the axial fitting hole and is coupled to the axial fitting hole so that they can be coaxially rotated integrally and drives the water pump 35 together with the balancer shaft 32.

A separate gear 37 is provided to a boss of the other balancer weight 34 so that the gear can be integrally rotated. The gear 37 is engaged with an oil pump gear 38, the oil pump gear 38 rotates an integrated driving shaft 39 and drives an oil pump 40. The driving shaft 39 is supported by the case L 20 in parallel with the balancer shaft 32. The oil pump 40 is formed on the side of the case L 20 and is in part combined with the case R 21.

For the supply of oil to the oil pump 40, oil is sent from an oil reservoir 41 formed at the bottom of the case R 21 of the crankcase 8 to an oil pan via a lead valve not shown by the rotation of a crank web 42. Oil sent from the oil pump 40 in a state in which pressure is applied is supplied from a discharge passage 43 to required locations such as an oil passage 46 provided to the core of the crankshaft 7 via an oil filter 44 provided on the inner side of the case L cover 22 and an oil passage 45 formed inside the case L cover 22.

Figure 4:
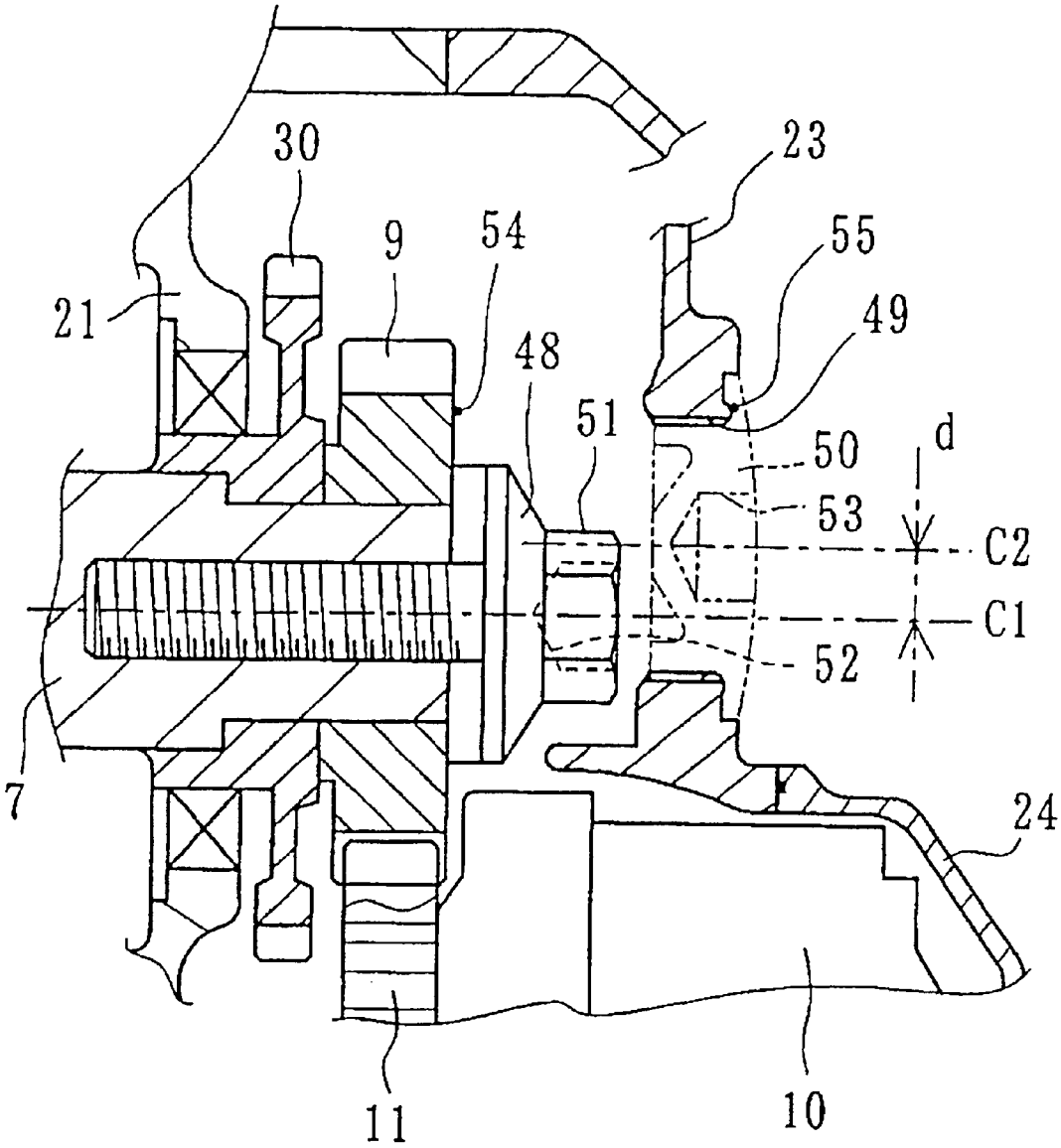
FIG. 4 is an enlarged sectional view showing a window for performing work.

As shown in FIGS. 2 to 4, the primary drive gear 9 and the balancer drive gear 30 are fixed at the end on the right side of the crankshaft 7 on the reverse side to the side on which ACG 28 is provided by a bolt 48. A window for performing work 49 is open to the case R cover 23 in the vicinity of the bolt 48 and is covered with a cap 50 screwed thereon.

As shown in FIG. 4, the axis of the bolt 48, that is, the axis C1 of the crankshaft 7 and the center line C2 of the window for performing work 49 and the cap 50 are off by a dimension d. The bolt 48 has a hexagon head 51 and in the center, a hexagonal concave portion 52 is formed. A hexagonal concave portion 53 is also provided to the cap 50.

Figure 5:
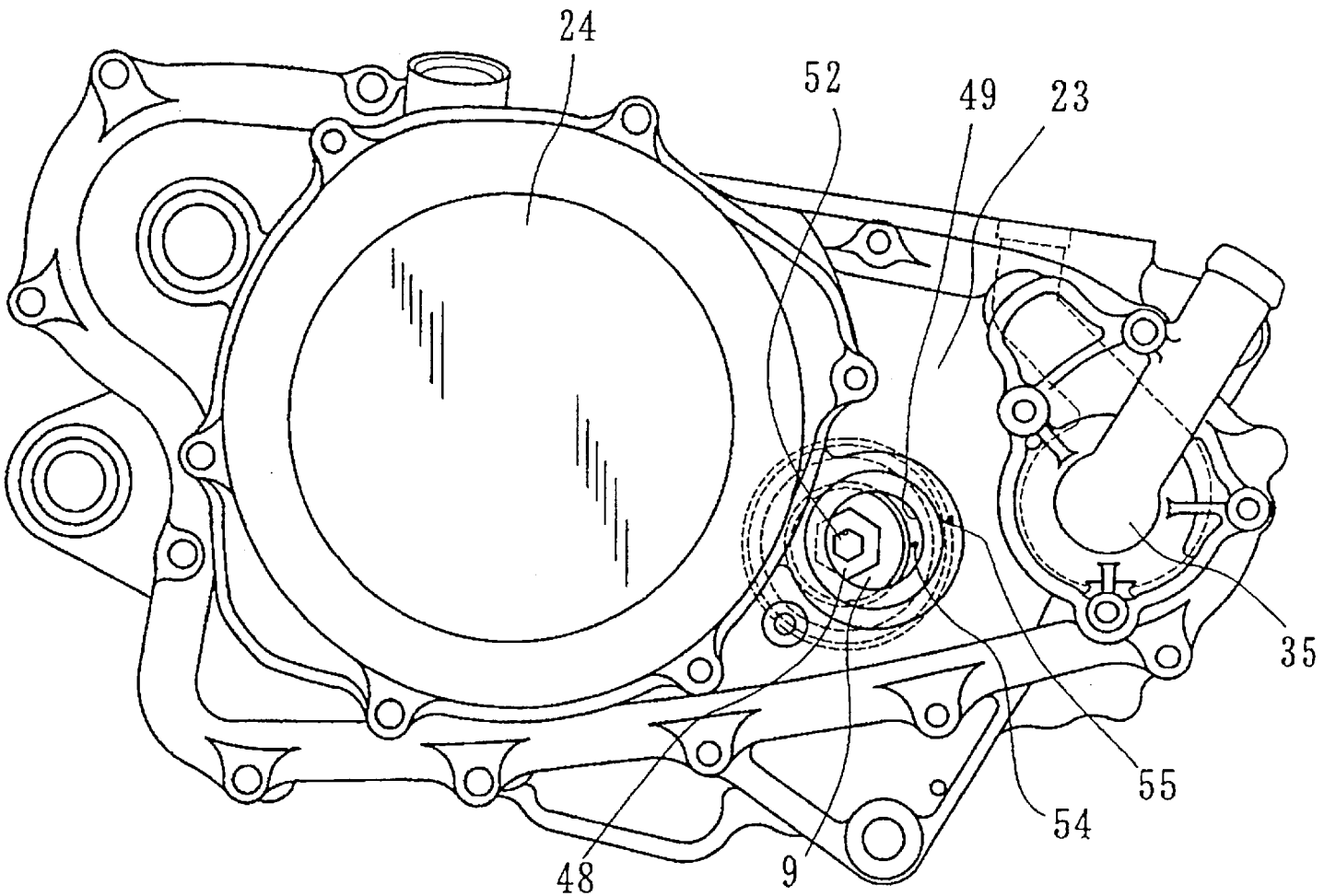
FIG. 5 is a side view showing the side of the outside surface of a case R cover.

The window for performing work 49 is located in a position and has a size in which an alignment mark 54 is provided to the whole head 51 and the outside peripheral side in the vicinity of the teeth of the primary drive gear 9 can be viewed as shown in FIG. 5, and is located in a position which does not interfere with the clutch cover 24. An alignment mark 55 is matched with the alignment mark 54 and is provided to the edge of the window for performing work 49. The alignment marks 54 and 55 shown in FIG. 4 are exaggeratingly drawn to definitely show the positions and are different from actual ones.

As is clear from FIG. 5, the alignment mark 55 is formed in the form of a triangle for example at the edge of the window for performing work 49 according to a suitable method such as a marking. In the meantime, the alignment mark 54 is formed in the form of a circle for example according to a suitable method such as marking and both marks are arranged so that they are close when they are matched. The alignment mark 54 of the primary drive gear 9 is set so that a crank is located in a position at a time when a piston is located in a top dead center when the alignment mark 54 is matched with the alignment mark 55. The crankshaft 7 and the primary drive gear 9 are connected via a spline and the primary drive gear 9 is necessarily built in the crankshaft 7 in phase with the combination of phases at this time.

Next, the action of this embodiment will be described. As shown in FIGS. 2 and 3, as the window for performing work 49 is provided to the case R cover 23 on the side of the clutch in a position in the vicinity of an extended line of the crankshaft 7 and no window for performing work is provided to the case L cover 22 on the side of ACG 28, a lubrication structure in which oil is supplied from the oil passage 45 provided to the case L cover 22 to the oil passage 46 of the crankshaft 7 via the side of ACG is enabled. Therefore, the oil passage 45 can be made relatively short and simple.

As shown in FIGS. 4 and 5, as the window for performing work 49 is provided to the case R cover 23 on the side of the clutch and the bolt 48 located at the end of the crankshaft 7 and the alignment mark 54 of the primary drive gear 9 can be simultaneously viewed, the rotation of the crankshaft 7 can be adjusted by the bolt 48, checking the alignment mark 54 from the same window for performing work 49 and a top dead center of the crankshaft 7 can be adjusted by matching the alignment mark 54 on the side of the primary drive gear 9 with the alignment mark 55 of the case R cover 23. Therefore, the adjustment of the phase of the crankshaft 7 is facilitated, as one window for performing work 49 has only to be provided, the structure of the window for performing work 49 can be simplified and in addition, one cap 50 has only to be provided.

At this time, as the hexagonal concave portion 52 is provided to the head 51 in a hexagonal convex shape of the bolt 48, the convex shape having a large diameter formed on the side of the outside periphery of the head 51 is used when the head is tightened with a large torque. When the crankshaft 7 is rotated with a small torque for adjustment, a tool having a smaller diameter than the convex shape via the window for performing work 49 from the outside is fitted to the hexagonal concave portion 52 and the crankshaft 7 can be rotated.

In addition, the bolt 48 and the alignment mark 54 can be simultaneously viewed by setting the center C2 of the window for performing work 49 off the axis C1 of the crankshaft 7 and the area of an opening can be reduced. In addition, the window for performing work can be arranged in a position in which interference with the clutch 10 can be avoided. Therefore, the reduction of the number of parts, the lightening and the arrangement of the window for performing work 49 compatible with the adjacent clutch 10 can be realized.

The invention is not limited to the above-mentioned embodiment and various transformations and applications are allowed in the same principle of the invention. For example, the alignment mark 54 may be also provided to the crankshaft itself or a member rotated integrally with the crankshaft except the primary drive gear 9.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crankshaft phase adjustment structure for an engine in which a primary drive gear is provided to a side of one end of a crankshaft and an ACG is provided to a side of the other end comprising:

an oil passage provided within an axis of the crankshaft, said oil passage of the crankshaft being open to the end of the crankshaft on the side of ACG;

a window for performing work for adjusting a phase is formed in a position in the vicinity of an extended line of the axis of the crankshaft of a case cover on the side of the primary drive gear; and an alignment mark is provided to the crankshaft or a part rotated integrally with the crankshaft that can be viewed from the window for performing work and the edge of the window for performing work, the center of the window for performing work being set off the axis of the crankshaft.

2. The crankshaft phase adjustment structure according to claim 1, wherein a second alignment mark is provided adjacent to the window for performing work.

3. The crankshaft phase adjustment structure according to claim 2, wherein when the alignment mark and the second alignment mark are aligned, a piston of the engine is positioned at top dead center.

4. The crankshaft phase adjustment structure according to claim 1, wherein an oil passage for supplying oil to the oil passage in the crankshaft is directly connected to the oil passage in the crankshaft.

5. The crankshaft phase adjustment structure according to claim 1, wherein the alignment marking is provided adjacent to an outer peripheral side of the primary drive gear for enabling a viewing of gear teeth of said primary drive gear from the window for performing work.

6. The crankshaft phase adjustment structure according to claim 3, wherein the alignment mark is a triangle and the second alignment mark is a circle.

7. A viewing window for a crankshaft phase adjustment for an engine comprising:

a primary drive gear being provided to a first side of one end of a crankshaft;

an ACG being provided to a second side of the crankshaft;

a window for performing work for adjusting a phase is formed in a position in the vicinity of an extended line of the axis of the crankshaft of a case cover on the side of the primary drive gear; and an alignment mark is provided to the crankshaft or a part rotated integrally with the crankshaft that can be viewed from the window for performing work and the edge of the window for performing work, the center of the window for performing work being set off the axis of the crankshaft.

8. The crankshaft phase adjustment structure according to claim 7, wherein a second alignment mark is provided adjacent to the window for performing work.

9. The crankshaft phase adjustment structure according to claim 8, wherein when the alignment mark and the second alignment mark are aligned, a piston of the engine is positioned at top dead center.

10. The crankshaft phase adjustment structure according to claim 7, wherein an oil passage is provided within an axis of the crankshaft, said oil passage of the crankshaft being open to second side of the crankshaft on the side of ACG and an oil passage for supplying oil to the oil passage in the crankshaft is directly connected to the oil passage in the crankshaft.

11. The crankshaft phase adjustment structure according to claim 7, wherein the alignment marking is provided adjacent to an outer peripheral side of the primary drive gear for enabling a viewing of gear teeth of said primary drive gear from the window for performing work.

12. The crankshaft phase adjustment structure according to claim 9, wherein the alignment mark is a triangle and the second alignment mark is a circle.

* * * * *